US005478188A

United States Patent [19]

Rea et al.

[11] Patent Number: 5,478,188

[45] Date of Patent: Dec. 26, 1995

[54] PROGRAMMABLE CONTROLLED TAILGATE COMPACTION MECHANISM FOR REAR-LOADING REFUSE VEHICLES

[75] Inventors: George A. Rea, Signal Mountain, Tenn.; Darrel D. Huff, Jr., Morganfield, Ky.

[73] Assignee: The Heil Company, Chattanooga, Tenn.

[21] Appl. No.: 337,198

[22] Filed: Feb. 13, 1995

Related U.S. Application Data

[63] Continuation-in-part of Ser. No. 239,356, May 5, 1994, abandoned.

[51] Int. Cl.[6] ..... B65F 3/20

[52] U.S. Cl. ..... 414/525.54

[58] Field of Search ..... 414/525.3, 525.4, 414/525.5, 525.51, 525.52, 525.53, 525.54, 525.55

[56] References Cited

U.S. PATENT DOCUMENTS

| | | | |
|---|---|---|---|
| 3,092,269 | 6/1963 | Brown et al. | 414/525.54 |
| 3,297,180 | 1/1967 | Park et al. | 414/525.54 |
| 3,455,471 | 7/1969 | Merther | 414/525.54 |
| 3,696,951 | 10/1972 | Toppins et al. | 414/525.54 X |
| 3,777,917 | 12/1973 | Herpich et al. | 414/525.52 |
| 3,786,946 | 1/1974 | Toppins et al. | 414/786 |
| 4,029,224 | 6/1977 | Herpich et al. | 414/525.52 |
| 4,050,594 | 9/1977 | Gollrick | 414/525.54 X |
| 4,065,008 | 12/1977 | Ratledge | 414/525.54 |
| 4,406,573 | 9/1983 | Colin | 414/525.54 |
| 4,453,880 | 6/1984 | Leisse | 414/525.53 |
| 4,460,307 | 7/1984 | Durant et al. | 414/525.4 |
| 4,786,228 | 11/1988 | Mazzocchia et al. | 414/525.1 |
| 4,863,336 | 9/1989 | Gasparini | 414/525.54 |
| 5,015,144 | 5/1991 | Smith et al. | 414/525.54 |

FOREIGN PATENT DOCUMENTS

| | | | |
|---|---|---|---|
| 2097711 | 3/1972 | France . | |
| 2687386 | 8/1993 | France | 414/525.54 |
| 3236208 | 4/1984 | Germany . | |
| 1582698 | 1/1981 | United Kingdom . | |
| 2167036 | 5/1986 | United Kingdom | 414/525.54 |

*Primary Examiner*—David A. Bucci
*Attorney, Agent, or Firm*—McAndrews, Held & Malloy Ltd.

[57] ABSTRACT

A tailgate assembly for a refuse collection vehicle includes a swing-link compaction mechanism and accommodates rear-mounted lifting mechanisms for refuse containers. Upper and lower torsion members extend between the tailgate side walls. The upper torsion member is spaced horizontally from the rearmost edge of the tailgate side wall, and the lower torsion member is spaced horizontally from the rearmost edge of the tailgate side wall at least to the same extent as the upper torsion member. Because of the horizontal spacing of the upper and lower torsion members from the rearmost edge of the tailgate side wall, a large, unobstructed upper opening is provided to accommodate the hoisting and inverting of refuse containers.

11 Claims, 7 Drawing Sheets

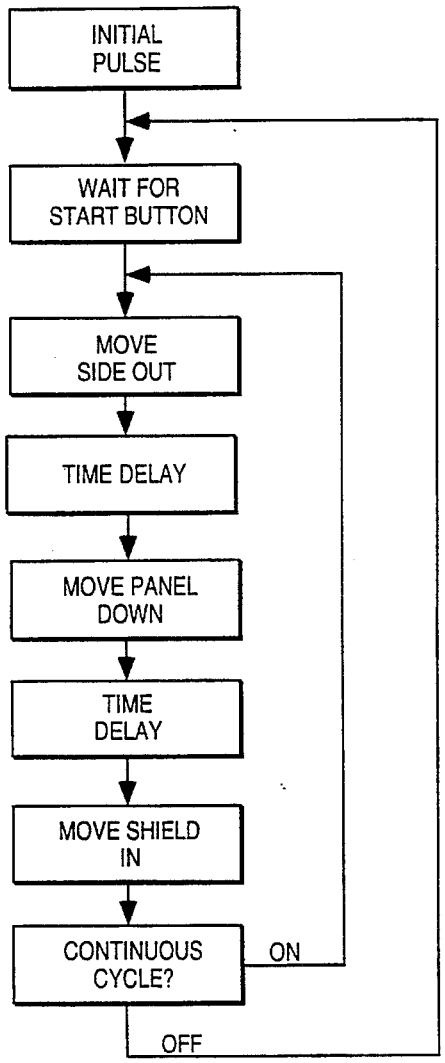
Fig. 7
Fig. 8
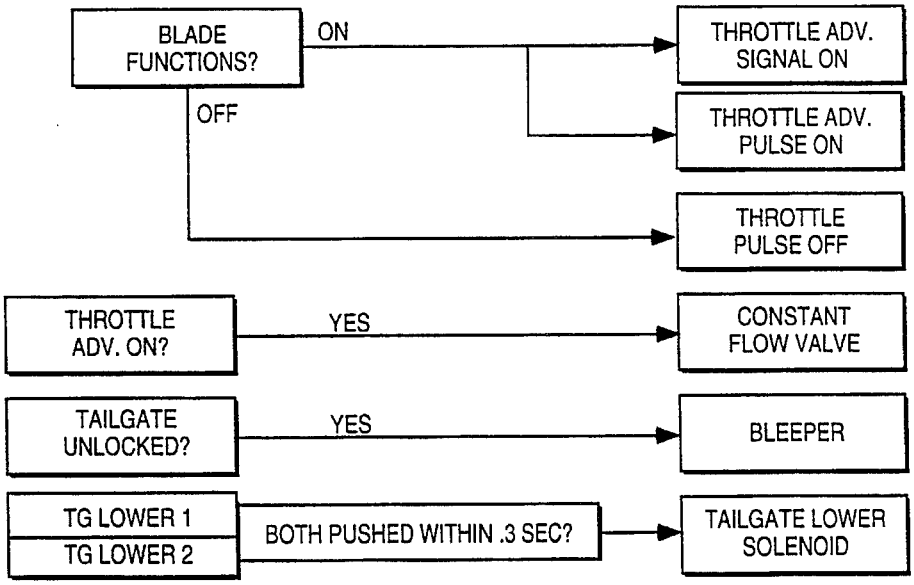

PROGRAMMABLE CONTROLLED TAILGATE COMPACTION MECHANISM FOR REAR-LOADING REFUSE VEHICLES

CROSS-REFERENCE TO RELATED APPLICATION

This application is a continuation-in-part of U.S. application Ser. No. 08/239,356, filed May 5, 1994, now abandoned.

FIELD OF THE INVENTION

The present invention relates to a tailgate packing mechanism for a rear-loading refuse vehicle. More: particularly, the present invention relates to a programmable controlled, swing-link tailgate packing mechanism for a rear-loading refuse vehicle.

BACKGROUND OF THE INVENTION

Refuse collection vehicles generally have a body supported by wheels for containing compacted refuse within a chamber within the body. In rear-loading refuse vehicles, a tailgate assembly is mounted on the rearward portion of the refuse vehicle body. The tailgate assembly generally includes a hopper for receiving refuse and an opening at the forward portion of the hopper which communicates with the refuse-containing chamber. The tailgate assembly also generally includes a refuse compaction mechanism for sweeping refuse from within the hopper into the refuse vehicle body. In addition to sweeping the refuse from the hopper, the compaction mechanism urges the refuse forward into the chamber of the body, thereby compacting the refuse within the chamber.

The hopper of a tailgate assembly is adapted to receive refuse containers of various sizes which are either supported by an operator who dumps a container into the hopper or by a lifting mechanism which vertically hoists the container above the hopper and then inverts the container to dump the refuse into the hopper. Such lifting mechanisms, which are particularly popular in Europe, are usually mounted at the rearmost portion of the tailgate mechanism so that refuse containers can be readily attached and released at ground level.

Conventional tailgate assemblies, such as those described in U.S. Pat. Nos. 3,786,946, and 4,460,307, are generally unsuitable for use in combination with rear-mounted lifting mechanisms. In the tailgate assembly disclosed in U.S. Pat. No. 3,786,946, a transverse beam extends across the upper portion of the rearmost edge of tailgate. The transverse beam impedes refuse containers from being hoisted and inverted above the hopper by lifting mechanisms. Similarly, in the tailgate assembly disclosed in U.S. Pat. No. 4,460,307, a rigid cross member extends across the upper portion of the rearmost edge of the tailgate, impeding the hoisting and inverting of refuse containers above the hopper by lifting mechanisms.

In connection with the compaction mechanism of tailgate assemblies, it is generally necessary for the packer panel to have at least two travel paths: the first to accommodate the handling of bulky objects (such as appliances), and the second to limit the vertical rotation of the packer panel in order to clear containers and container covers in their dumped positions to make it possible to dump a container at any time during a packing cycle.

To provide the above two travel paths, the compaction mechanism is supported by a swing-link arrangement including a packer panel pivotally connected to an upper shield swing-link and to a lower link pivotally connected to the rear of the tailgate. For the bulky object mode, the packer panel pivots full up and in its rearmost pivoted position is well above the hopper loading lip in order to provide maximum clearance over an object in the hopper. For the container mode, the packer panel is restricted in its vertical rotation so as to swing to the rear, thereby remaining under and clear of containers and container covers.

The combination of programmable logic controllers with swing-link compaction mechanisms provides additional benefits in the collection and transportation of refuse materials. In this regard, programmable logic controllers can actuate certain extensible components of the compaction mechanism so as to induce the compaction mechanism to travel a first path as described above for the bulky object mode and, alternatively, to travel a second path as described above for the container mode.

Accordingly, it is an object of the present invention to provide a tailgate assembly for a refuse collection vehicle which includes a swing-link compaction mechanism and which accommodates rear-mounted lifting mechanisms for refuse containers.

It is also an object of the invention to provide a tailgate assembly for a refuse collection vehicle which includes a swing-link compaction mechanism and which includes a large, substantially unobstructed upper portion for accommodating refuse containers hoisted and inverted above the hopper by lifting mechanisms.

It is a further object of the invention to provide a tailgate assembly for a refuse collection vehicle which includes a swing-link compaction mechanism and programmable controls for actuating certain extensible components of the compaction mechanism to direct the compaction mechanism along a number of predetermined travel paths.

SUMMARY OF THE INVENTION

The above and other objects are achieved by a tailgate assembly for a refuse collection vehicle with an internal refuse storage chamber. The tailgate assembly comprises opposite tailgate side walls connected by a tailgate floor and a tailgate top panel to define a rearward refuse loading hopper. The hopper is separated from the chamber by an interior wall, the interior wall having a lower edge cooperating with the tailgate floor to define an opening connecting the hopper to the chamber. The tailgate assembly also comprises a compaction mechanism comprising a shield extending between the tailgate side walls and a packer panel extending between the tailgate side walls and pivotally connected to a lower portion of the shield. The tailgate assembly further comprises:

upper and lower torsion members extending between the tailgate side walls, the upper torsion member spaced horizontally from the rearmost edge of the tailgate side wall, the lower torsion member spaced horizontally from the rearmost edge of the tailgate side wall at least to the same extent as the upper torsion member, the lower torsion member being disposed between the upper torsion member and the tailgate floor;

a pair of oppositely disposed upper links pivotally connected at one end to the upper end of the shield and pivotally connected at the other end to a fixed location in the tailgate assembly;

a pair of oppositely disposed lower links pivotally connected at one end to an upper portion of the packer panel and pivotally connected at the other end to the tailgate side wall at a location spaced horizontally rearwardly from the upper torsion member;

a pair of oppositely disposed upper cylinders having an actuating rod projecting therefrom, the upper cylinders pivotally connected at one end to the tailgate top panel and pivotally connected at the other end to an upper portion of the packer panel;

a pair of oppositely disposed lower cylinders having an actuating rod projecting therefrom, the lower cylinders pivotally connected at one end to the tailgate side wall at a location spaced horizontally rearwardly from the upper torsion member and pivotally connected at the other end to a lower portion of the packer panel.

In the preferred tailgate assembly, the upper cylinders are pivotally connected at their other end to an upper portion of the packer panel at the pivotal connection between the packer panel and the shield. The lower links are preferably pivotally connected at their one end to an upper portion of the packer panel at the pivotal connection between the packer panel and the shield. The lower cylinders are preferably oriented such that the ends of the actuating rods projecting therefrom are pivotally connected to the tailgate side wall. The upper cylinders are also preferably oriented such that the ends of the actuating rods projecting therefrom are pivotally connected to a combination hinge/cylinder cross member.

The most preferred tailgate assembly preferably further comprises at least one pair of oppositely disposed torsion brackets interconnecting the upper and lower torsion members. Each torsion bracket comprises an outer plate reinforcing the tailgate side wall and shrouding the torsion members, as well as a substantially identical inner plate shrouding the torsion members and located as close as practical to the lower link and the lower cylinder. The inner and outer plates are preferably welded to the torsion members and are tied to each other by short transverse plates preferably welded, in turn, to the inner and outer plates and to the torsion members.

In the preferred tailgate assembly, the upper cylinders are pivotally connected at their one end to a cross member fixedly attached to the tailgate top panel.

In the most preferred tailgate assembly, the upper and lower torsion members are formed from tube stock.

In the preferred tailgate assembly, the actuating rods of the upper and lower cylinders are actuated by signals from a programmable logic controller. The preferred tailgate assembly further comprises means for detecting the extent to which the actuating rods project from the cylinders, the detecting means being electrically connected to the programmable logic controller. In the preferred tailgate assembly, the programmable logic controller is also capable of generating a plurality of signal patterns such that the actuating rods are actuated to urge the compaction mechanism along a plurality of predetermined travel paths.

BRIEF DESCRIPTION OF THE DRAWINGS

FIG. 7 is a block diagram of the sequential operations executed by the programmable logic controller in directing movement of the compaction mechanism.

FIG. 8 is a block diagram of the parallel operations executed by the programmable logic controller.

DETAILED DESCRIPTION OF THE PREFERRED EMBODIMENTS

Figure 1:
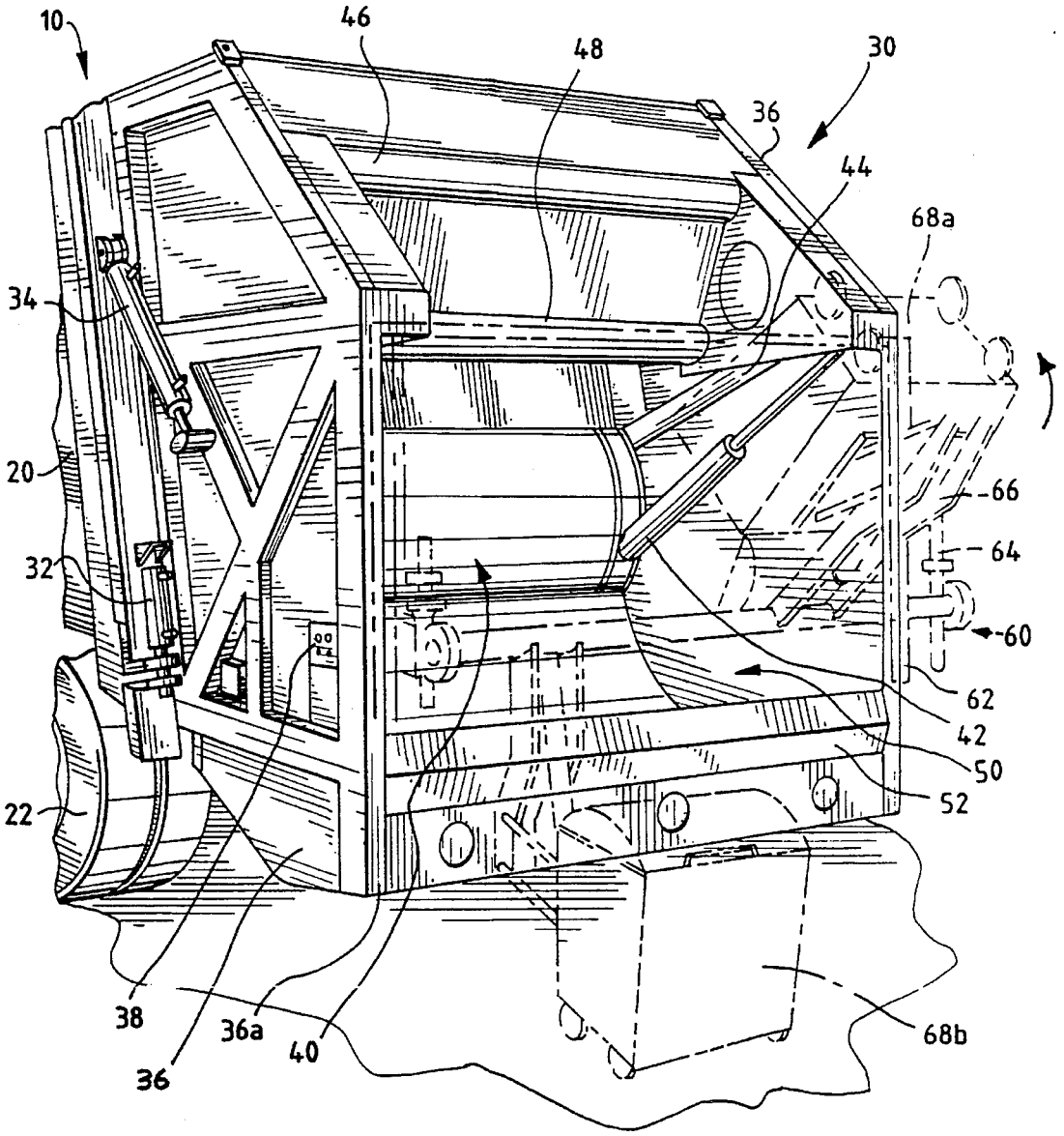
FIG. 1 is a rear perspective view of a rear-loading refuse collection vehicle with the programmable controlled tailgate compaction mechanism of the present invention.

Turning first to FIG. 1, a rear-loading refuse vehicle 10 includes a body 20 supported by wheels 22 for containing compacted refuse within a chamber (not shown) within the body 20. A tailgate assembly 30 is mounted on the rearward portion of refuse vehicle body 20. Tailgate assembly 30 includes a hydraulic cylinder 34 for raising and rotating tailgate assembly 30 about a pivot at the upper portion of body 20, in order to expose the refuse-containing chamber within body 20 for removal of the compacted refuse from the chamber at, for example, a refuse disposal site. Tailgate assembly 30 also includes a hydraulic cylinder 32 for securing assembly 30 in its downward position to body 20 at times other than during the removal of the compacted refuse from the chamber. A rear wall assembly 52 extends between the oppositely disposed side walls 36 of tailgate assembly 30. Rear wall assembly 52 includes an upper shelf portion which accommodates the dumping of a refuse container into hopper 50 by an operator.

Tailgate assembly 30 includes a hopper 50 for receiving refuse and an opening (not shown in FIG. 1) at the forward portion of hopper 50 which communicates with the refuse-containing chamber of body 20. The tailgate assembly 30 also generally includes a refuse compaction mechanism 40 for sweeping refuse from within hopper 50 into refuse vehicle body 20. In addition to sweeping the refuse from hopper 50, compaction mechanism 40 urges the refuse forward within the chamber of body 20, and thereby also compacts the refuse within chamber 20. Compaction mechanism 40 is pivotally supported by, among other support members illustrated and described hereinafter, lower cylinder 42 and lower link 44.

An arrangement of torsion members, shown in FIG. 1 as upper torsion member 46 and lower torsion member 48, provides structural support for the tailgate assembly 30, and resists rotational forces imposed upon the tailgate assembly by operation of the compaction mechanism 40.

A refuse container lifting mechanism 60 is shown in FIG. 1 as including a frame 62 fixedly mounted at the rearmost edge of side walls 36, a lifting member 64 which is vertically movable on frame 62, and an arm assembly 66 for hoisting and inverting refuse container 68a for dumping into hopper 50, as shown, FIG. 1 shows a counterpart lifting mechanism, which is substantially identical to lifting mechanism 60, for hoisting and inverting refuse container 68*b* from its ground-level position. For hoisting and inverting refuse containers, such as for example 1100 liter containers commonly used in Europe, both lifting mechanism 60 and its counterpart would be employed simultaneously.

Figure 2:
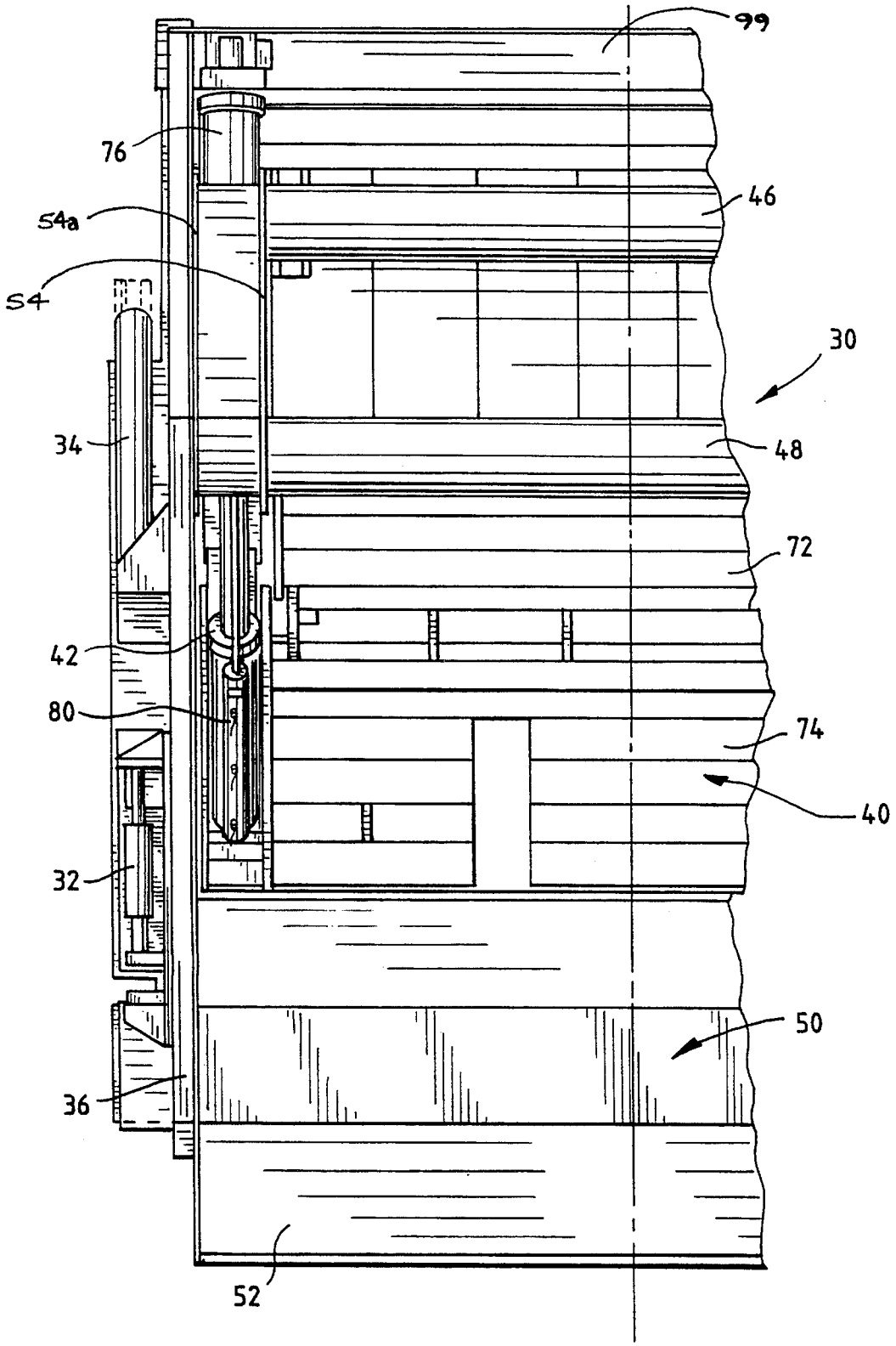
FIG. 2 is a rear elevation view of the programmable controlled tailgate compaction mechanism illustrated in FIG. 1.

FIG. 2 shows a rear elevation view of tailgate assembly 30. In particular, FIG. 2 shows the relative locations of hydraulic cylinder 34 for raising tailgate assembly 30, hydraulic cylinder 32 for securing assembly 30, side wall 36, compaction mechanism 40, hopper 50, and rear wall assembly 52. As shown in FIG. 2, compaction mechanism 40 comprises a shield 72 extending between the tailgate side walls, one of which is shown in FIG. 2 as side wall 36, and a packer panel 74 extending between the tailgate side walls and pivotally connected to a lower portion of shield 72. Upper and lower cylinders 42 and 76, respectively, pivotally support compaction mechanism 40 within the tailgate assembly 30. Upper and lower torsion members 46 and 48, as well as inner and outer plates 54 and 54a which envelope torsion members 46 and 48, provide structural support for the tailgate assembly 30, and cooperate to resist rotational forces imposed upon the tailgate structure by operation of the compaction mechanism 40.

Figure 3:
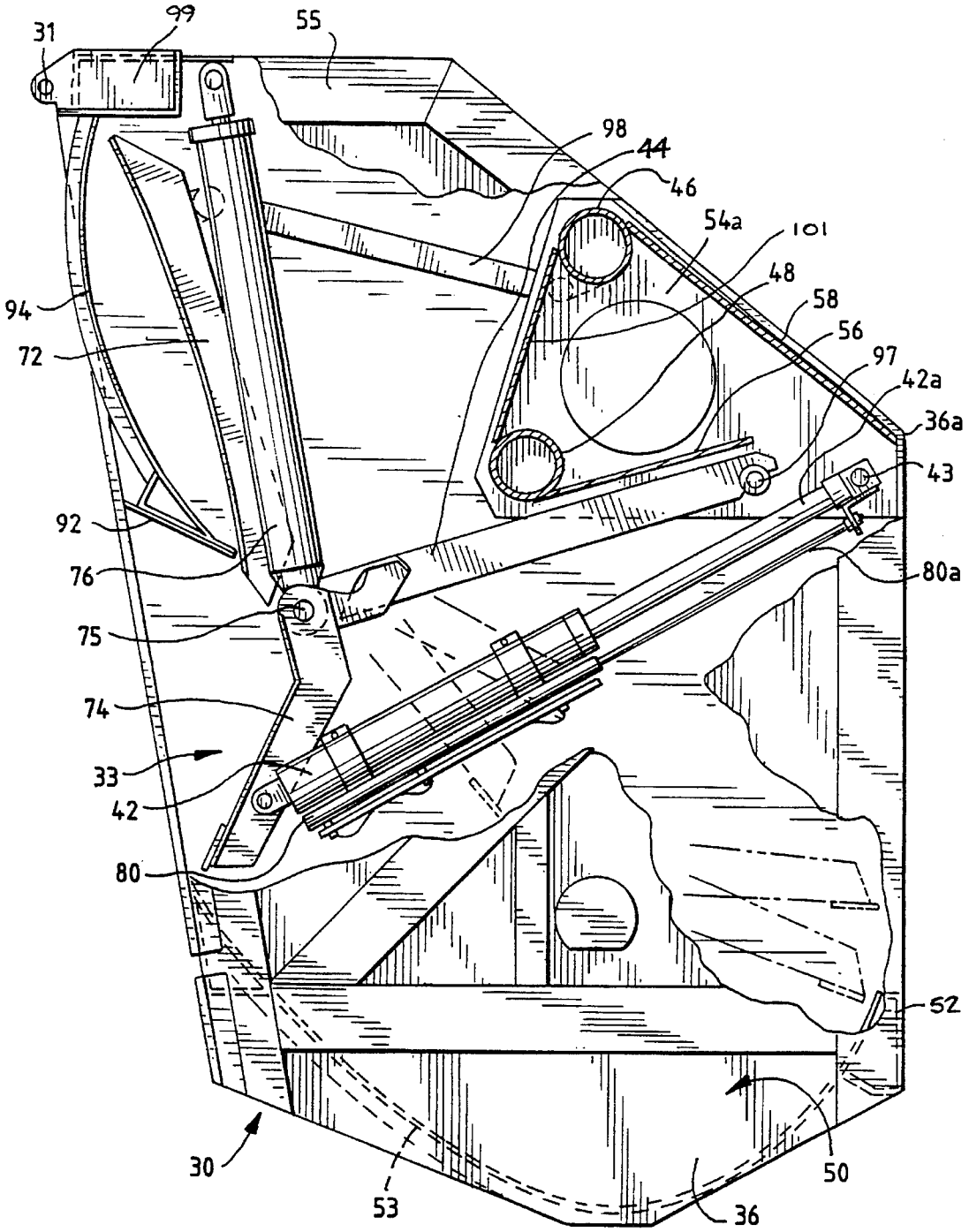
FIG. 3 is a side elevation view, partially in section of the programmable controlled tailgate compaction mechanism illustrated in FIG. 1.

FIG. 3 is a side elevation view of tailgate assembly 30. Tailgate assembly 30 is pivotally attached by pin 31 to an upper portion of the adjacent vehicle body (not shown in FIG. 3). Tailgate assembly 30 comprises opposite tailgate side walls, one of which is illustrated in FIG. 3 as side wall 36, connected by a tailgate floor 53 and a tailgate top panel 55 to define a rearward refuse loading hopper 50. Hopper 50 is separated from refuse-containing chamber of the adjacent vehicle body (not shown in FIG. 3) by an interior wall 94. Interior wall 94 has a lower edge which cooperates with the tailgate floor 53 to define an opening 33 connecting hopper 50 to the chamber.

Tailgate assembly 30 also includes a compaction mechanism comprising a shield 72 extending between the tailgate side walls and a packer panel 74, also extending between the tailgate side walls and pivotally connected to a lower portion of shield 72, as shown in FIG. 3.

Upper and lower torsion members 46 and 48 extend between the tailgate side walls. Upper torsion member 46 is spaced horizontally from the rearmost edge 36*a* of tailgate side wall 36. Lower torsion member 48 is also spaced horizontally from the rearmost edge 36*a* of tailgate side wall 36 at least to the same extent as upper torsion member 46. As shown in FIG. 3, lower torsion member 48 is disposed between upper torsion member 46 and the tailgate floor 53. Upper and lower torsion members 46 and 48 are preferably formed from tube stock.

A pair of torsion brackets at each side of the tailgate are connected to the upper and lower torsion members 46 and 48. The torsion bracket comprises an outer plate 54*a* and an inner plate 54 (see also FIG. 2). Outer plate 54*a* reinforces the tailgate side wall 36 and envelopes torsion members 46 and 48. Inner plate 54 is spaced inwardly from outer plate 54*a*, and is located as close as practical to cylinder 42 and lower link 44. Inner plate 54 also envelopes torsion members 46 and 48. Plate 54*a* is preferably welded to tailgate side wall 36, as well as to torsion members 46 and 48. Plate 54 is preferably welded to torsion members 46 and 48. Plates 54 and 54*a* are tied to each other by short transverse plates 56, 58 and 101, which are also preferably welded to torsion members 46 and 48.

A pair of oppositely disposed upper links, one of which is illustrated in FIG. 3 as upper link 98, is pivotally connected at one end to the upper end of shield 72 and pivotally connected at the other end to a fixed location on the tailgate assembly, such as, for example, upper torsion member 46, as shown. It is to be understood that torsion member 46 is simply a convenient location for the mounting of upper link 98, and that equivalent fixed locations such as a separate cross member or a structure attached to inner plate 54, and the like, could also be employed.

A pair of oppositely disposed lower links, one of which is illustrated in FIG. 3 as lower link 44, is pivotally connected at one end to an upper portion of packer panel 74 and pivotally connected at the other end to the tailgate side wall 36 at a location 97 which is spaced horizontally rearwardly from upper torsion member 46.

A pair of oppositely disposed upper cylinders, one of which is illustrated in FIG. 3 as cylinder 76, has an actuating rod projecting therefrom (not shown in FIG. 3). Upper cylinder 76 is pivotally connected at one end to a combination hinge/cylinder cross member 99. Upper cylinder 76 is pivotally connected at the other end to an upper portion of packer panel 74. A pair of oppositely disposed lower cylinders, one of which is illustrated in FIG. 3 as cylinder 42, has an actuating rod 42*a* projecting therefrom. Lower cylinder 42 is pivotally connected at one end to tailgate side wall 36 at a location 43 spaced horizontally rearwardly from the upper torsion member 46, and is pivotally connected at the other end to a lower portion of packer panel 74. A detector 80, illustrated and described hereinafter, perceives the extent to which the actuating rod 42*a* projects from cylinder 42, thereby gauging the relative distance of packer panel 74 from location 43.

As shown in FIG. 3, upper cylinder 76 is preferably pivotally connected at its lower end to an upper portion of packer panel 74 at the pivotal connection 75 between packer panel 74 and shield 72. Lower link 96 is also preferably pivotally connected at its forwardmost end to an upper portion of packer panel 74 at the pivotal connection 75 between packer panel 74 and shield 72.

As shown in FIG. 3, lower cylinder 42 is preferred oriented such that the end of the actuating rod 42*a* projecting therefrom is pivotally connected to tailgate side wall 36. This orientation is preferred so as to distance the actuating rod from the refuse material being dumped from above into hopper 50, so that fouling of the actuating rods is avoided. Similarly, upper cylinder 76 is preferably oriented such that the end of the actuating rod projecting therefrom is pivotally connected to cross member 99, as shown in FIG. 3.

FIG. 3 shows, in phantom lines, two of the positions achievable by packer panel 74 along its possible travel paths defined by the rotation of lower link 44, and by the rotation and extension of cylinders 76 and 42.

Figure 4:
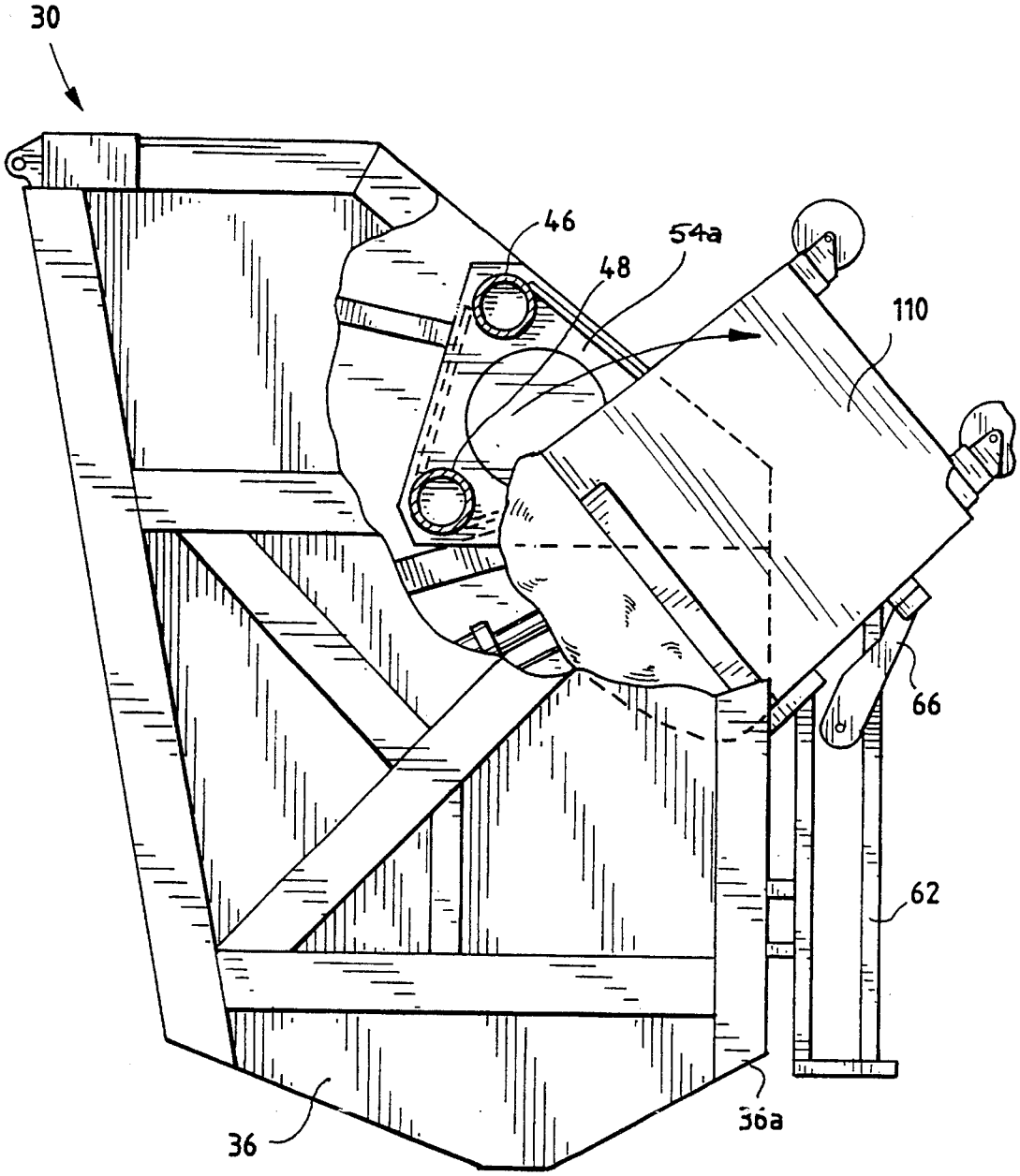
FIG. 4 is a side elevation view, partially in section of the programmable controlled tailgate compaction mechanism illustrated in FIGS. 1 and 3, showing the hoisting and inverting of a refuse container above the hopper.

FIG. 4 is a side elevation view of tailgate assembly 30 illustrated in FIGS. 1 and 3, which includes side wall 36. FIG. 4 shows the hoisting and inverting of a refuse container 110 above the hopper by a lifting mechanism including frame 62 and arm assembly 66. Because of the horizontal spacing of upper and lower torsion members 46 and 48 from the rearmost edge 36*a* of side wall 36, a large, unobstructed upper opening is provided to accommodate the hoisting and inverting of refuse containers like container 110. The hoisting and inverting of refuse containers like container 110 is not achievable with tailgate designs incorporating transverse beams or rigid cross members at the rearmost edge of tailgate.

Figure 5:
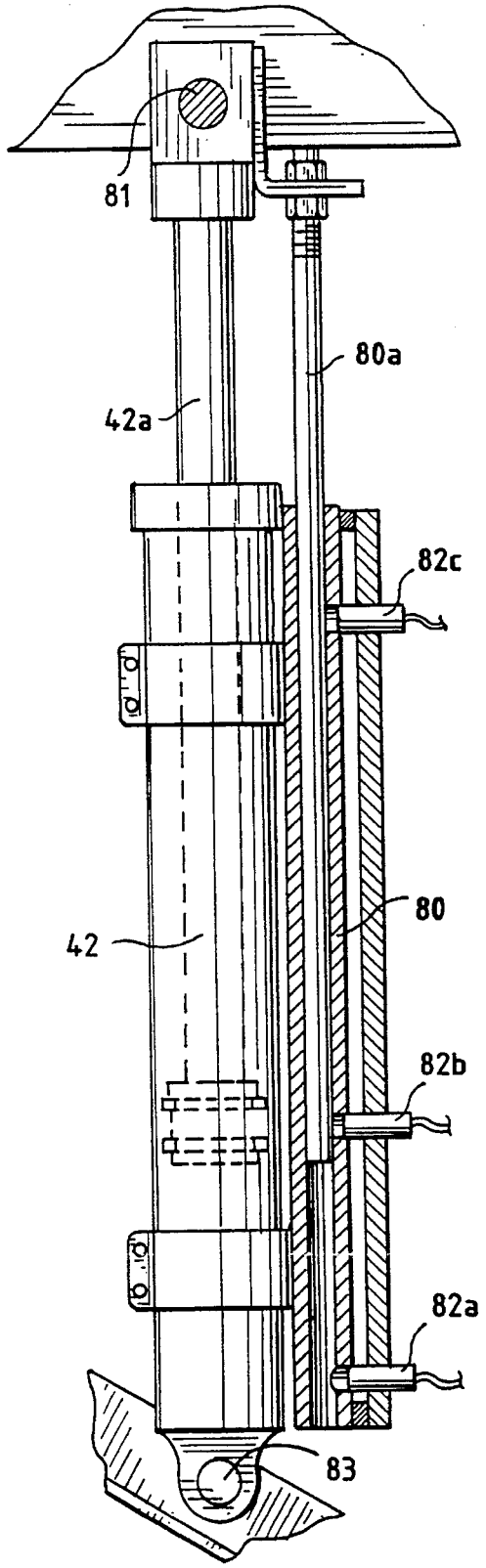
FIG. 5 is a rear elevation view of the detector which gauges the extent to which the actuating rods project from the cylinders in the tailgate compaction mechanism illustrated in FIG. 2.

FIG. 5 is a rear elevation view of the detector 80 which gauges the extent to which the piston rod 42*a* projects from cylinder 42. As shown, detector 80 includes a rod 80*a* which projects from detector 80. Detector 80 also includes a plurality of proximity detectors 82*a*, 82*b* and 82*c*, each of which generates a signal when rod 80*a* is proximate. Thus, depending upon which combination or single one of proximity detectors 82*a*, 82*b* and 82*c* is generating a signal, the distance that rod 80*a* extends from detector 80 can be calculated. Since detector 80 is fixedly attached to cylinder 42, the displacement of cylinder pivot connection 83 from pivot connection 81 can also be calculated to derive the relative position of the packer panel attached at pivot connection 83.

Figure 6:
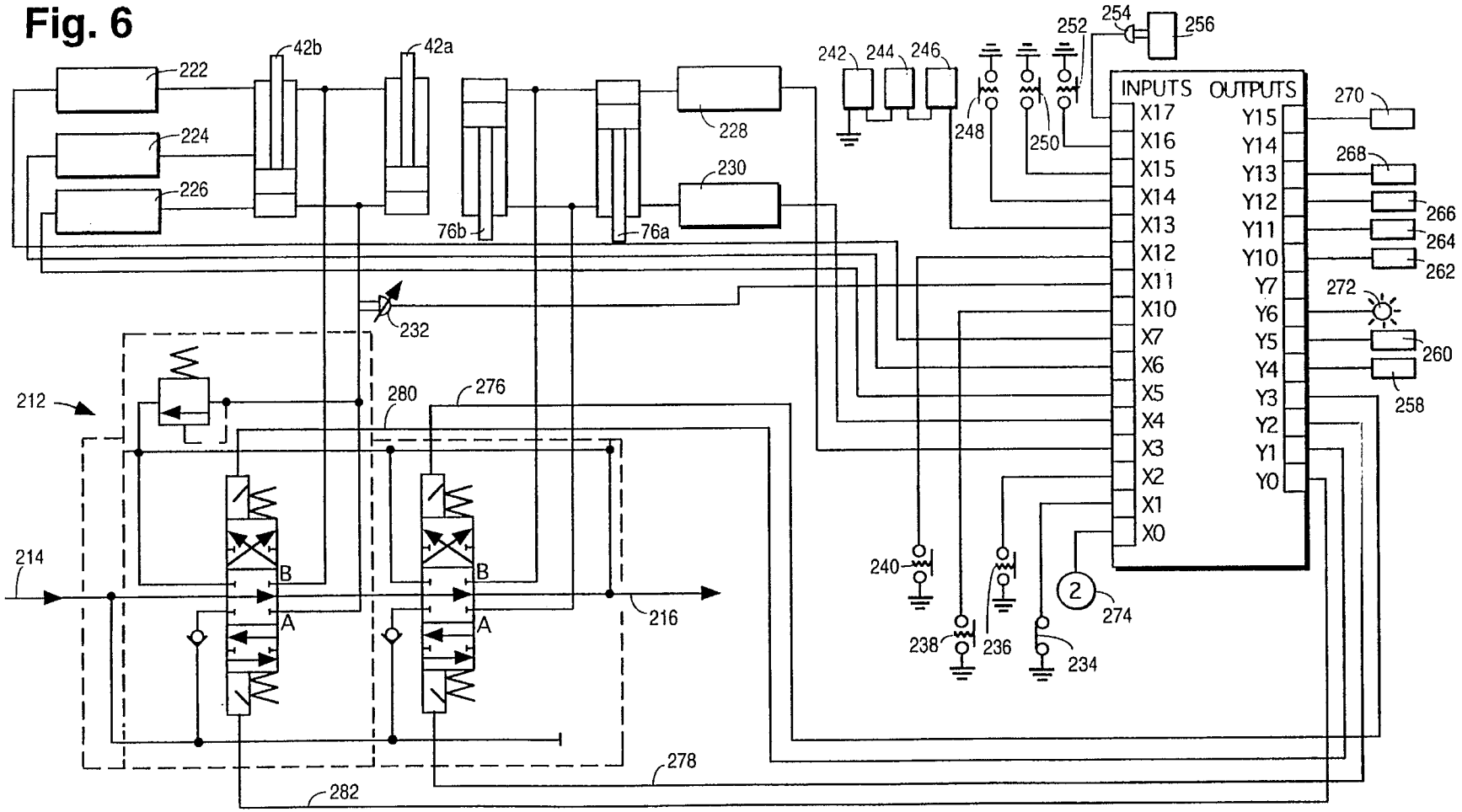
FIG. 6 is a schematic diagram of the electrical and hydraulic circuitry associated with the programmable logic controller which receives electrical signals from switches on the control panel and from proximity detectors associated with the cylinders, and generates signals to the hydraulic circuit components which extend and retract the actuating rods of the cylinders pivotally connected to the tailgate compaction mechanism illustrated in FIGS. 1–3.

FIG. 6 is a schematic diagram of the electrical and hydraulic circuitry associated with the programmable logic controller ("PLC") 210. Programmable controllers like PLC 210 are available commercially as, for example, Model $FX_0$-30MT-DSS, which has 16 inputs and 14 outputs, available from Mitsubishi Electronics America, Inc., Industrial Automation Division, located in Mount Prospect, Ill., USA.

PLC 210 receives electrical signals from switches on the control panel of the refuse vehicle (not shown) and from proximity detectors associated with the oppositely disposed lower cylinders 42*a* and 42*b* and the oppositely disposed upper cylinders 76*a* and 76*b*. Each of lower cylinders 42*a* and 42*b* has one end pivotally connected to a lower portion of the packer panel of the tailgate mechanism (not shown in FIG. 6). Each of the upper cylinders 76*a* and 76*b* has one end pivotally connected to an upper portion of the packer panel.

PLC 210 generates signals to actuate the components of the hydraulic circuitry 212 which extends and retracts the actuating rods of cylinders 42*a*, 42*b*, 76*a* and 76*b* associated with the tailgate compaction mechanism. In FIG. 6, stream 214 represents the flow of pressurized hydraulic fluid or oil into the hydraulic circuitry 212. Stream 216 represents the flow of pressurized hydraulic fluid or oil out of the hydraulic circuitry 212.

The input signals to PLC 210 are designated in FIG. 6 as X0, X1, X2, X3, X4, X5, X6, X7, X10, X11, X12, X13, X14, X15, X16 and X17. The output signals to PLC 210 are designated as Y0, Y1, Y2, Y3, Y4, Y5, Y6, Y7, Y10, Y11, Y12, Y13, Y14 and Y15. As shown in FIG. 6, the inputs and outputs to PLC 210 are as follows:

222/X7= proximity switch indicating lower cylinder is fully extended (packer panel has been fully lowered);

224/X6= proximity switch indicating lower cylinder has reached "normal" retracted position (packer panel has been partially raised);

226/X5= proximity switch indicating lower cylinder is fully retracted (packer panel has been fully raised);

228/X3= proximity switch indicating upper cylinder is fully retracted (shield has been fully raised);

230/X4= proximity switch indicating upper cylinder is fully extended (shield has been fully lowered);

232/X11= lower cylinder pressure switch (associated with packer panel);

234/X1= emergency stop switch on control panel;

236/X2= "Bulky Operation" switch on control panel;

238/X10= "Start" switch on control panel;

240/X12= "Continuous Cycle" switch on control panel;

242/X13= Tailgate closed proximity switch;

244/X13= Tailgate locked proximity switch (left-hand side);

246/X13= Tailgate locked proximity switch (right-hand side);

248/X14= Tailgate lower switch #1;

250/X15= Tailgate lower switch #2;

252/X16= Throttle advance switch;

254/X17= Bypass switch for oil filter 256;

258/Y4= Throttle advance continuous signal;

260/Y5= Throttle advance pulse on signal;

262/Y10= Buzzer;

264/Y11= Tailgate open alarm;

266/Y12= Tailgate lower solenoid;

268/Y13= Throttle advance pulse off signal;

270/Y15= Constant flow valve solenoid;

272/Y6= Filter warning light;

274/X0= Alternator signal input;

276/Y3= Signal to actuate flow of hydraulic fluid to extend actuating rods of upper cylinders 76*a* and 76*b*;

278/Y2= Signal to actuate flow of hydraulic fluid to retract actuating rods of upper cylinders 76*a* and 76*b*;

280/Y1= Signal to actuate flow of hydraulic fluid to extend actuating rods of lower cylinders 42*a* and 42*b*;

282/Y0= Signal to actuate flow of hydraulic fluid to retract actuating rods of lower cylinders 42*a* and 42*b*.

FIG. 7 is a block diagram of the sequential operations executed by the programmable logic controller 210 of FIG. 6, in directing movement of the compaction mechanism.

FIG. 8 is a block diagram of the parallel operations executed by the programmable logic controller 210 of FIG. 6.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. In a tailgate assembly for a refuse collection vehicle, said vehicle comprising a wheel-supported body for receiving and containing refuse, said body comprising opposite vehicle side walls connected by a vehicle floor and a vehicle roof to define a forward refuse storage chamber, said tailgate assembly comprising opposite tailgate side walls connected by a tailgate floor and a tailgate top panel to define a rearward refuse loading hopper, said hopper separated from said chamber by an interior wall, said interior wall having a lower edge cooperating with said tailgate floor to define an opening connecting said hopper to said chamber, said tailgate assembly further comprising a compaction mechanism comprising a shield extending between said tailgate side walls and a packer panel extending between said tailgate side walls and pivotally connected to a lower portion of said shield; the improvement comprising:

upper and lower torsion members extending between said tailgate side walls, said upper torsion member spaced horizontally from the rearmost edge of said tailgate side wall, said lower torsion member spaced horizontally from the rearmost edge of said tailgate side wall at least to the same extent as said upper torsion member, said lower torsion member disposed between said upper torsion member and said tailgate floor;

a pair of oppositely disposed upper links pivotally connected at one end to an upper end of said shield and pivotally connected at the other end to a fixed location in said tailgate assembly;

a pair of oppositely disposed lower links pivotally connected at one end to an upper portion of said packer panel and pivotally connected at the other end to said tailgate side wall at a location spaced horizontally rearwardly from said upper torsion member;

a pair of oppositely disposed upper cylinders having an actuating rod projecting therefrom, said upper cylinders pivotally connected at one end to said tailgate top panel and pivotally connected at the other end to an upper portion of said packer panel;

a pair of oppositely disposed lower cylinders having an actuating rod projecting therefrom, said lower cylinders pivotally connected at one end to said tailgate side wall at a location spaced horizontally rearwardly from said upper torsion member and pivotally connected at the other end to a lower portion of said packer panel.

2. The tailgate assembly of claim 1 wherein said upper cylinders are pivotally connected at their other end to an upper portion of said packer panel at the pivotal connection between said packer panel and said shield.

3. The tailgate assembly of claim 2 wherein said lower links are pivotally connected at their one end to an upper portion of said packer panel at the pivotal connection between said packer panel and said shield.

4. The tailgate assembly of claim 1 wherein said lower cylinders are oriented such that the end of the actuating rods projecting therefrom is pivotally connected to said tailgate side wall.

5. The tailgate assembly of claim 4 wherein said upper cylinders are oriented such that the end of the actuating rods projecting therefrom is pivotally connected to an upper portion of said packer panel.

6. The tailgate assembly of claim 1 wherein said upper cylinders are pivotally connected at said one end to a cross member fixedly attached to said tailgate top panel.

7. The tailgate assembly of claim 1 further comprising at least one pair of oppositely disposed torsion brackets, said brackets fixedly attached to said upper and lower torsion members and substantially shrouding said upper and lower torsion members.

8. The tailgate assembly of claim 1 wherein said upper and lower torsion members are formed from tube stock.

9. The tailgate assembly of claim 1 wherein the actuating rods of said upper and lower cylinders are actuated by signals from a programmable logic controller.

10. The tailgate assembly of claim 9 further comprising means for detecting the extent to which said actuating rods project from said cylinders, said detecting means electrically connected to said programmable logic controller.

11. The tailgate assembly of claim 9 wherein programmable logic controller is capable of generating a plurality of signal patterns such that said actuating rods are actuated to urge said compaction mechanism along a plurality of predetermined travel paths.

* * * * *